US007540542B2

(12) United States Patent
Geringer et al.

(10) Patent No.: US 7,540,542 B2
(45) Date of Patent: Jun. 2, 2009

(54) ELECTRIC STRIKE

(75) Inventors: Arthur V. Geringer, Oak Park, CA (US); David A. Geringer, Camarillo, CA (US); Richard Geringer, Moorpark, CA (US)

(73) Assignee: Security Door Controls, Westlake Village, CA (US)

( * ) Notice: Subject to any disclaimer, the term of this patent is extended or adjusted under 35 U.S.C. 154(b) by 0 days.

(21) Appl. No.: 11/725,110

(22) Filed: Mar. 14, 2007

(65) Prior Publication Data

US 2008/0224481 A1 Sep. 18, 2008

(51) Int. Cl.
*E05B 15/02* (2006.01)

(52) U.S. Cl. ..... 292/341.16; 292/341.17

(58) Field of Classification Search ..... 292/144, 292/341.16, 341.17

See application file for complete search history.

(56) References Cited

U.S. PATENT DOCUMENTS

| | | | | |
|---|---|---|---|---|
| 6,299,225 | B1 * | 10/2001 | Chang | 292/341.16 |
| 6,874,830 | B2 | 4/2005 | Bashford | 292/341.16 |
| 7,185,928 | B1 * | 3/2007 | Liao | 292/341.16 |
| 7,246,827 | B2 * | 7/2007 | Geringer et al. | 292/144 |

* cited by examiner

*Primary Examiner*—Gary Estremsky
(74) *Attorney, Agent, or Firm*—Koppel, Patrick, Heybl & Dawson

(57) ABSTRACT

An electric strike comprising a housing and a keeper pivotally mounted to said housing. A solenoid is arranged internal to the housing and movable between fail-safe and fail-secure positions. A two position mode control slot is included in the housing and a mode control screw is included in the mode control slot. The screw is capable of being tightened in each of the two positions in the control slot. The screw is changeable between the two of the positions without removal of the screw. The solenoid is in the fail-safe position when the screw is in one of the two positions and in the fail-secure position when the screw is in the other of the two positions.

21 Claims, 4 Drawing Sheets

FIG. 7
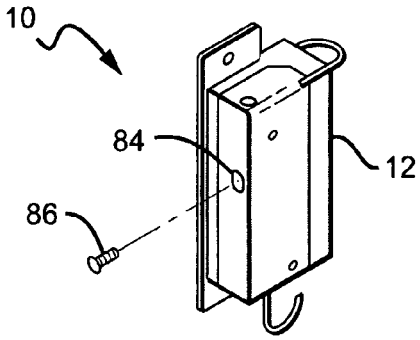
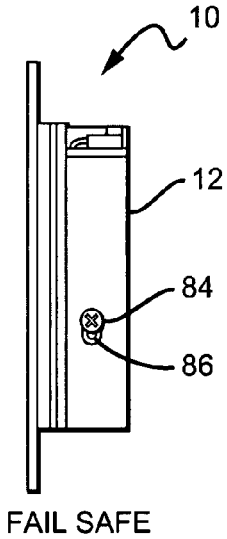
FIG. 8
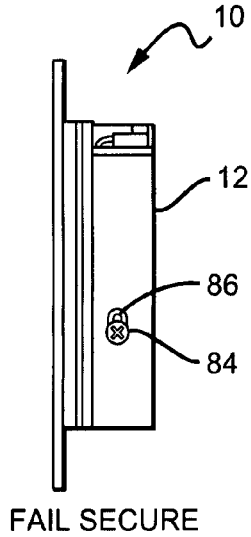
FIG. 9
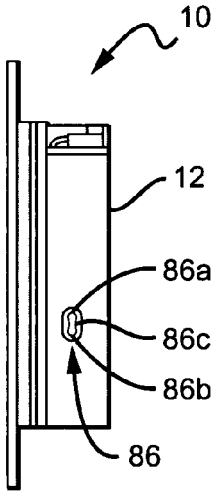
FIG. 10
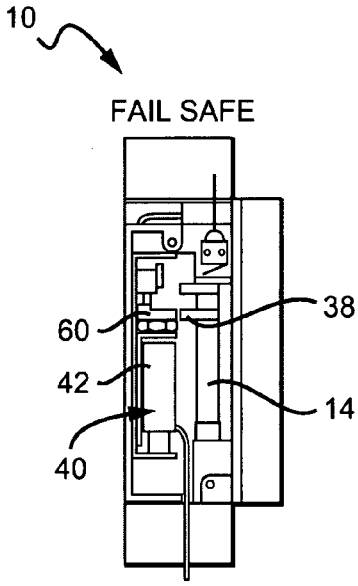
FIG. 11
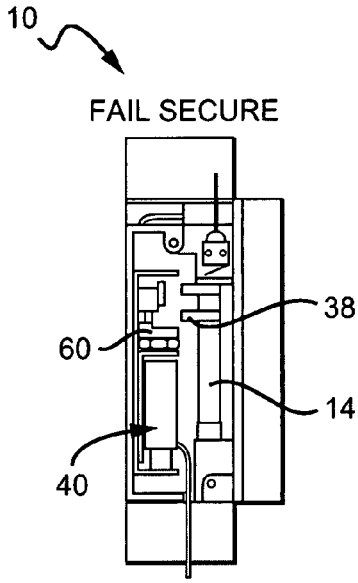
FIG. 12

ELECTRIC STRIKE

BACKGROUND OF THE INVENTION

1. Field of the Invention

This invention relates to strikes for doors, and in particular to electric strikes that can be changed to operate in fail-safe and fail-secure modes.

2. Description of the Related Art

Door locking mechanisms and security doors to prevent theft or vandalism have evolved over the years from simple doors with heavy duty locks to more sophisticated egress and access control devices. Hardware and systems for limiting and controlling egress and access through doors are generally utilized for theft-prevention or to establish a secured area into which (or from which) entry is limited. For example, retail stores use such secured doors in certain departments (such as, for example, the automotive department) which may not always be manned to prevent thieves from escaping through the door with valuable merchandise. In addition, industrial companies also use such secured exit doors to prevent pilferage of valuable equipment and merchandise.

Electric strikes, also known as electric door openers, are a class of door mechanisms that have been developed to control access to buildings or areas. An actuation means (e.g. an electrically driven motor or solenoid) is used to either block or release a rotatable keeper to either prevent or allow release of a door's latch bolt, to lock the door or allow it to be opened. Typically, electric strikes have two modes, namely a "fail-secure" mode (where the door is locked with the power removed, i.e. the actuation means must be triggered to allow the door to be opened), and a "fail-safe" mode (where the door is unlocked with the power removed, i.e. the actuation means must be triggered to prevent the door from being opened). Some strikes on the market have only one-mode capability, while others are dual mode allowing the installer to select which mode is desired at the time of installation.

Different dual-mode electric strikes have been developed such as the commercially available GEM model GK-300 and ROFO 2400 series models. Each has a solenoid mounted on a holder, which is movable within the strike housing. A blocking element is directly attached to the plunger of the solenoid, to block movement of the keeper when the strike is in its locked position. A first screw, reachable from outside the housing, cooperates with a slot in the housing, to define the path along which the holder is movable. When the first screw is tightened, it fastens the holder to the housing, i.e. the holder cannot move. First and second holes are arranged on the housing, to alternately align with a second screw, also reachable from outside the housing, so that at each end position along the holder path of movement, one of a threaded third or fourth hole, both arranged on the holder, is aligned with either the first hole or the second hole, and the second screw can be inserted into the appropriate first or second hole and screwed into the visible third or fourth hole. The installer can configure the GEM strike in either the fail-safe or fail-secure mode by selecting which holes are used. However, doing so is a tedious and tricky process, requiring proper alignment of holes, careful removal and replacement of one screw, and careful loosening of another screw.

U.S. Pat. No. 6,874,830 to Bashford describes an electric strike having a housing, a keeper pivotally arranged in the housing, and a holder slidably arranged in the housing. The electric strike also includes a blocking element slidably arranged in the holder. The blocking element is configured to selectively prevent a rotation of the keeper and allow the rotation of the keeper. The electric strike also includes a two-position mode selector operable from outside the housing, and the selector is configured to selectively move the holder from a first position to a second position and vice versa. The electric strike also includes an actuator configured to selectively move the blocking element. Specifically, when the holder is in the first position, the blocking member allows the rotation of the keeper when the actuator is energized and prevents the rotation of the keeper when the actuator is not energized, and when the holder is in the second position, the blocking member prevents the rotation of the keeper when the actuator is energized and allows the rotation of the keeper when the actuator is not energized.

SUMMARY OF THE INVENTION

One embodiment of an electric strike according to the present invention comprises a housing with a keeper pivotally mounted to the housing. An actuating device controlled by an electrical signal is arranged internal to the housing and is movable between two positions. A mode control screw is mounted to the electrical strike and is also capable of moving between two positions by loosening the screw, the movement of the screw causing movement of the actuating device between two positions. A blocking element is connected to the actuating device. In one of the two mode control screw positions the blocking element blocks pivot of the keeper when the electrical signal is lost. In the other of the mode control screw positions the blocking element allows pivot of the keeper when the electrical signal is lost.

Another embodiment of an electric strike according to the present invention comprises a housing and a keeper pivotally mounted to the housing. A two position mode control slot is included in the housing. A mode control screw is included in the mode control slot and is capable of being movable between and tightened in each of the two positions in the slot without removal of the screw. The screw is changeable between the two of the positions by loosening the screw. The electric strike operates in fail-safe mode when the screw is in one of the two positions and fail-secure mode when the screw is in the other of the two positions.

Still another embodiment of an electric strike according to the present invention comprises a housing and a keeper pivotally mounted to the housing. A solenoid is arranged internal to the housing and movable between fail-safe and fail-secure positions. A two position mode control slot is included in the housing. A mode control screw in the mode control slot is capable of being tightened in each of the two positions in the slot. The screw is changeable between the two of the positions without removal of the screw. The solenoid is in the fail-safe position when the screw is in one of the two positions and in the fail-secure position when the screw is in the other of the two positions.

These and other aspects and advantages of the invention will become apparent from the following detailed description and the accompanying drawings which illustrate by way of example the features of the invention.

BRIEF DESCRIPTION OF THE DRAWINGS

FIG. 7 is a left perspective view of the electric strike shown in FIG. 1;

FIG. 8 is a side view of the electric strike shown in FIG. 1 with the mode control screw in the fail-safe position;

FIG. 9 is a side view of the electric strike shown in FIG. 1 with the mode control screw in the fail-secure position;

FIG. 10 is a side view of the electric strike shown in FIG. 1 with the mode control screw removed;

FIG. 11 is a rear view of the electric strike in FIG. 1 with the rear plate removed showing the internal components in fail safe mode; and FIG. 12 is a rear view of the electric strike in FIG. 1 with the rear plate removed, showing the internal components in the fail secure mode.

DETAILED DESCRIPTION OF THE INVENTION

The present invention provides a simplified dual mode electric strike that allows for the user to change modes between fail-safe and fail-secure by the position of a single mode control screw. The mode control screw is accessible from outside of the housing and passes through a two position mode control slot in the housing. The screw turns into the threaded hole in a moveable slide that is internal to the electric strike housing. The slide contains blocking and actuating elements for operation of the strike in the dual modes. Movement of the slide between the two positions controls whether the electric strike operates in fail-safe or fail-secure mode. The position of slide is changed by loosening (and not removing) the mode control screw and moving it to one of the two positions in the mode control slot. As the screw is moved, the slide is also moved within the housing. When the screw is in the desired position it is then tightened. The slide is held in place by the holding force of the mode control screw and the surfaces of the housing.

It is understood that when an element or component is referred to as being "on", "connected to" or "coupled to" another element, it can be directly on, connected to or coupled to the other element or intervening elements may also be present. Furthermore, relative terms such as "front", "back", "inner", "outer", "upper", "above", "lower", "beneath", and "below", and similar terms, may be used herein to describe a relationship of one component of element to another. It is understood, however, that these terms are intended to encompass different orientations of the device in addition to the orientation depicted in the figures.

Although the terms first, second, etc. may be used herein to describe various elements or components these elements and components should not be limited by these terms. These terms are only used to distinguish one element or component from another element or component. Thus, a first element or component discussed below could be termed a second element or component without departing from the teachings of the present invention.

Embodiments of the invention are described herein with reference to certain illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the elements or components illustrated herein but are to include deviations in shapes that result, for example, from manufacturing. Thus, the regions illustrated in the figures are schematic in nature and their shapes are not intended to illustrate the precise shape of an element or component and are not intended to limit the scope of the invention.

Figure 1:
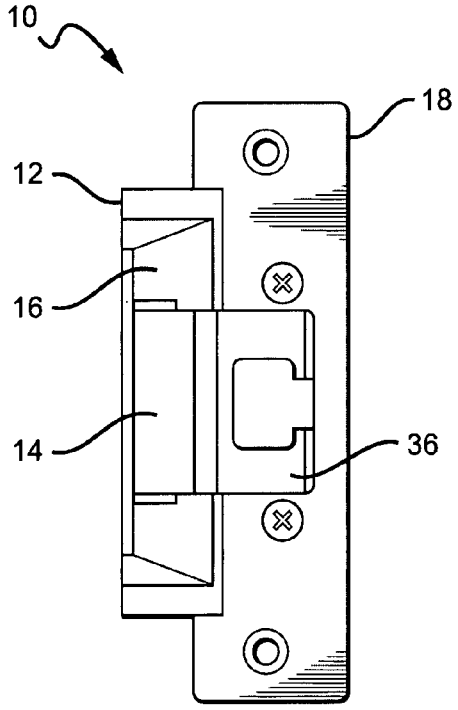
FIG. 1 is plan view of one embodiment of an electrical strike according to the present invention.
Figure 2:
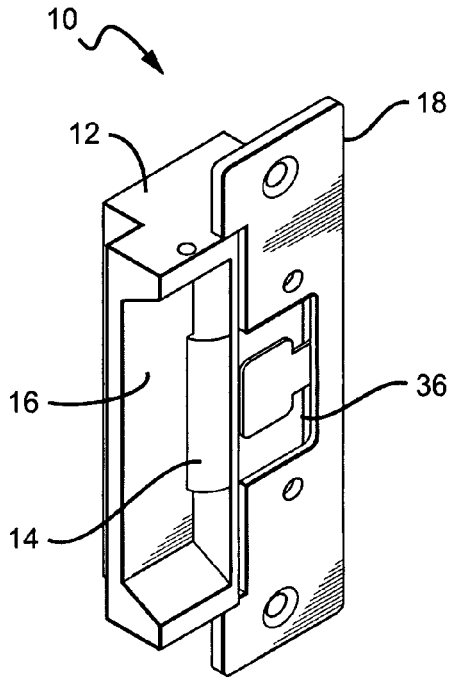
FIG. 2 is a left front perspective view of the electric strike shown in FIG. 1.
Figure 3:
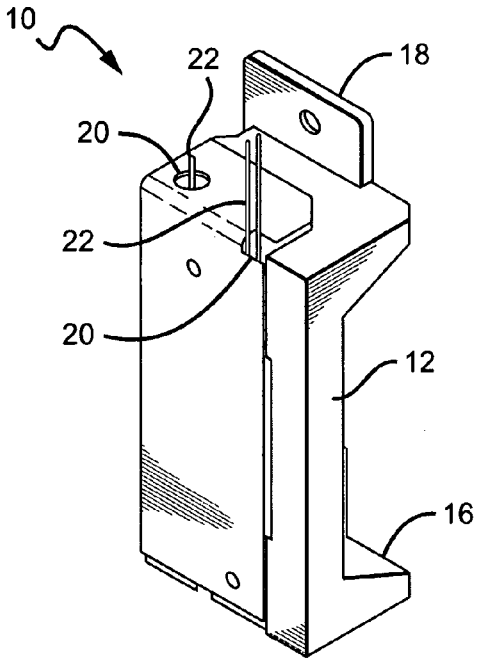
FIG. 3 is a right rear perspective view of the electric strike shown in FIG. 1.

Referring now to FIGS. 1-3, one embodiment of an electric strike 10 according to the present invention is shown and comprises a housing 12 holding the strike's internal components. A keeper 14 is pivotally arranged in keeper cavity 16 and operates in much the same way as conventional electric strike keepers. The keeper cooperates with a latch bolt of a door and pivots between two positions. The keeper functions differently depending on whether the electric strike is operating in door lock or door open. For door open, the keeper 14 can move to the open position by rotating out so that the latch bolt can be removed from the strike to open the door. In door lock the keeper 14 is prevented from moving, thereby blocking removal of the latch bolt and keeping the door locked. When the keeper 14 is allowed to pivot, the latch bolt can push the keeper 14 to rotate it out so that the door can be opened. The keeper 14 is typically urged to return to its home position by a suitable biasing means such as a torsion spring (not shown).

The housing 12 further comprises a face plate 18 that allows for mounting of the electric strike 10 into conventional door frame, and in particular a door jam. The electric strike 10 should be positioned within the door frame to cooperate with a conventional deadbolt or latch bolt of a door. The positioning and mounting of the electric strike 10 is known in the art and will not be discussed in detail herein. The housing 12 also comprises housing openings 20 for electrical conductors 22 to pass from the inside of the housing as best shown in FIG. 3. Different electrical conductors can be used with suitable electrical conductors 22 being conventional insulated wires. The conductors 22 are arranged to carry electrical signal to and/or from the electric strike's internal components, including but not limited to a solenoid or switches as further described below.

Figure 4:
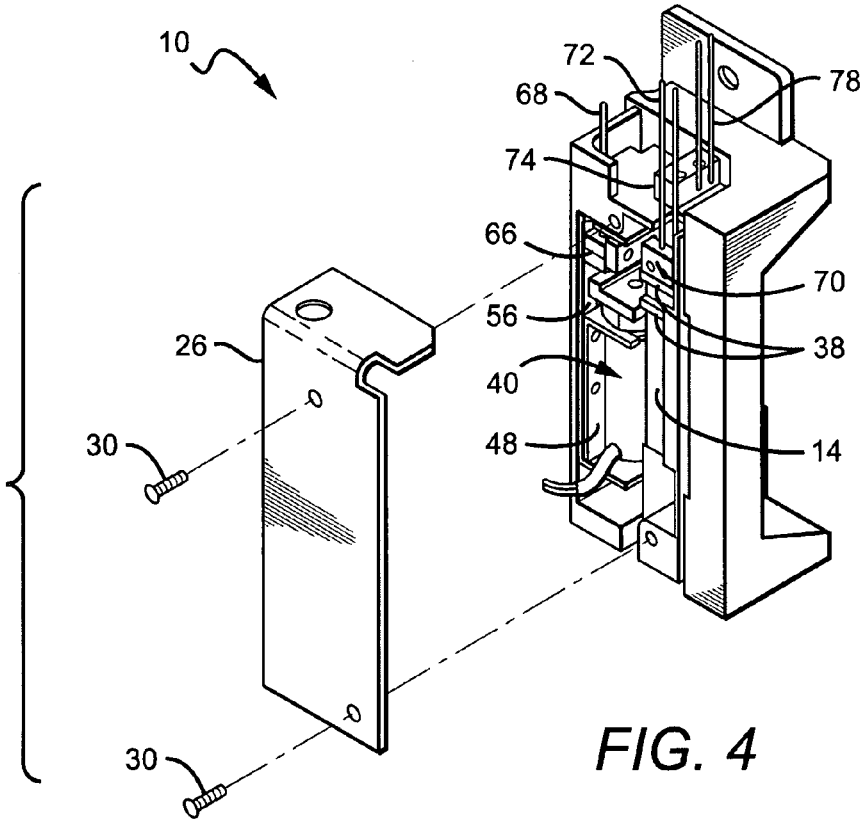
FIG. 4 is a right rear perspective view of the electric strike shown in FIG. 1 with the rear plate removed.
Figure 6:
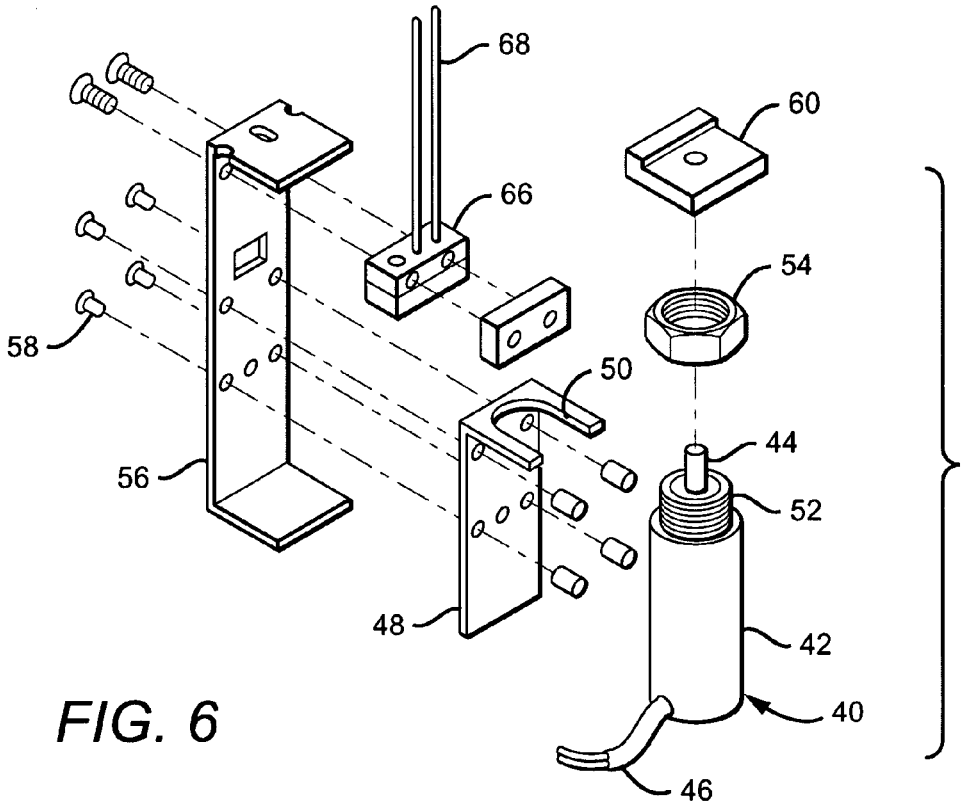
FIG. 6 is an exploded view of a solenoid assembly used in the electric strike shown in FIG. 1.
Figure 5:
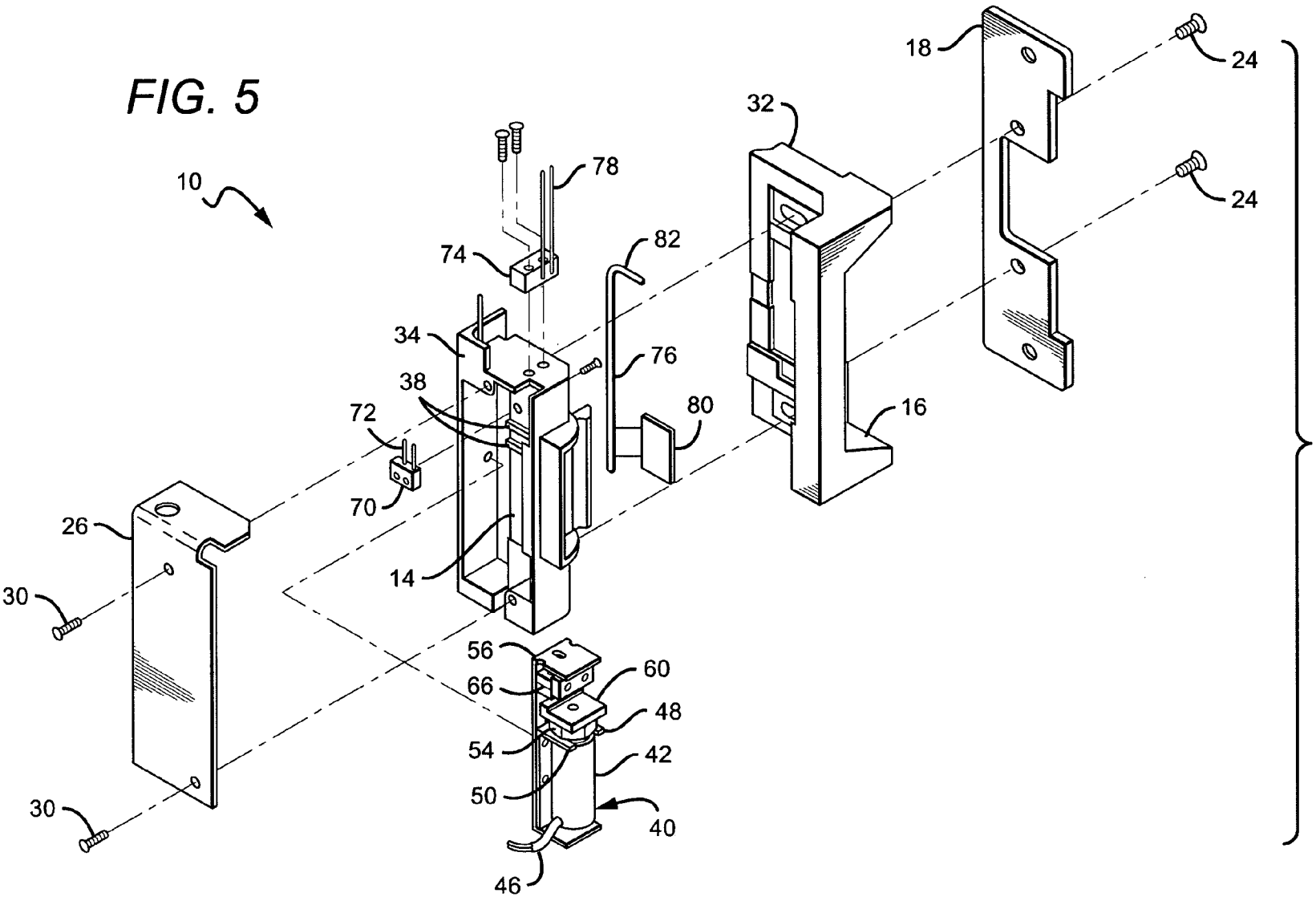
FIG. 5 is a right perspective exploded view of the electric strike shown in FIG. 1.

Referring now to FIGS. 4 through 6, the internal components of the electric strike 10 are shown. The face plate 18 is removable from the remainder of the housing 12 by front plate screws 24. The housing 12 further comprises a back plate 26 that can also be removed from the remainder of the housing 12 by back plate screws 30. The housing 12 can also be separated into front and rear portions 32, 34 with the front portion 32 arranged between the face plate 18 and the back portion 34. The front portion 32 generally comprises the keeper cavity 16 and has a latch bolt opening 36 (best shown in FIGS. 1 and 2) where the door latch bolt is positioned within the electric strike when the door is closed.

The housing rear portion 34 holds the keeper 14 and the strike's internal moving components. For the door to be locked, i.e. for the keeper 14 to be prevented from pivoting, the keeper has at least one abutting surface 38 that is blocked when the door is locked or when power is lost in a fail-secure mode. When the door is unlocked or power is lost in the fail-safe mode, the abutting surface 38 is not blocked and the keeper 14 is allowed to pivot.

The electric strike 10 further comprises actuating device 40 that can be controlled to block the abutting surface 38 when the door is locked and power is lost in the fail-secure mode. Different actuating devices 40 can be used, with a preferred device 40 being a solenoid. Solenoids are known in the art and only briefly described herein. As best shown in FIGS. 5 and/or 6, solenoid 40 comprises a solenoid body 42 with at least one internal coil surrounding a bore along the longitudinal axis of the body 42. A plunger 44 is arranged within the bore and extending from one end of the solenoid. Solenoid electrical conductors 46 are provided to apply an electrical signal to the internal coil. When an electrical signal is applied to the coil a magnetic field is created that either draws the plunger 44 into the bore or extends the plunger from the bore depending on the arrangement of the coil. Drawing the plunger in is typically referred to as a "pull" type solenoid and extending the plunger is typically referred to as a "push" type. The solenoid 40 can operate under different voltages such as 12 or 24 volts DC or AC. The solenoid can also be provided with dual coil winds to operate at different voltages and can be provided with four wires, two for each of the winds. This allows the user to choose which of the dual winds to use when installing the electric strike 10.

The solenoid 40 can be mounted in the housing 12 in many different ways, with one mounting embodiment according to the invention shown in FIGS. 4-6. The solenoid 40 is mounted to a solenoid mounting bracket 48 at the brackets' U-shaped opening 50. The solenoid 40 has a threaded portion 52 sized to fit in the U-shaped opening 50. A locking nut 54 is provided having threads to mate with the solenoid's threaded portion 52. When mounting the solenoid 40 to the bracket 48, the threaded portion 52 is placed in the U-shaped opening 50 and the locking nut 54 is turned on the threaded portion 52. When the nut 54 is tightened, the solenoid is held in place to the bracket with part of the U-shaped opening sandwiched between the nut 54 and the solenoid body 42.

The electric strike further comprises a movable slide 56, with the bracket 48 mounted to the slide 56. Many different mounting methods can be used such as mounting by screws or welding, with the mounting method as shown being by rivets 58.

A blocking element 60 is mounted to the solenoid 40 at the end of the extended plunger 44 and blocking element 60 moves as the plunger is extended from or drawn into the solenoid body 42. The blocking element is positioned in the housing 12 such that is can be moved to block the keeper's abutting surface 38 when the door is to be locked or power is lost in fail-safe mode. The blocking element 60 can have many different shapes and sizes, with a suitable blocking element being substantially square as shown. The slide 56 with its solenoid mounting bracket 48 is mounted within the housing's rear portion 34 by a mode control screw (shown and described below). The slide 56 can be moved within the rear portion 34 between two positions as described in more detail below. In the preferred embodiment, the two positions correspond to fail-safe and fail-secure operation of the electric strike 10.

The electric strike 10 can also be provided with different switches arranged in different locations to sense and report the status/position of certain components within the electric strike 10. The status/position of the components can then be monitored by a lock monitoring system.

A lock/unlock position switch 66 can be mounted to the slide 56 adjacent to the blocking element 60. When the plunger 44 extends from the solenoid body 42 the blocking element 60 actuates the position switch 66. The condition of the position switch 66 is reported by an electrical signal on the position switch conductors (wires) 68.

A keeper position switch 70 can be mounted to the housing rear portion 34 adjacent to the keeper 14, with the switch being activated by the pivot of the keeper 14. The condition of the keeper position switch 70 is reported on keeper position switch conductors 72.

A latch position switch 74 is also mounted to the rear portion 34 and cooperates with a latch lever 76 to sense and report to presence of a latch bolt within the electric strike 10. The lever 76 is rotatably mounted to the rear portion 34 with the engaging element 80 within the latch bolt opening 36 (best shown in FIGS. 1 and 2). When the latch bolt is positioned in the latch bolt opening, the engaging element 80 is pushed back by the latch bolt, causing the lever 76 to rotate and the top finger 82 to actuate the switch 74. The condition of the switch 74 is reported on latch position switch conductors 78. Beyond those described above, it is understood that many different switches can be used in many different locations within the electric strike 10.

Referring now to FIGS. 7-9, the electric strike 10 is shown with the mode control screw 84 in the mode control slot 86. As mentioned above, the mode control screw 84 is used to hold the slide 56 (shown in FIGS. 4-6) in one of two positions within the housing 12, with the mode control screw 84 turned into a threaded hole in the slide 56. The mode control slot 86 is shaped to have two positions for the mode control screw 84; upper and lower positions. As the screw 84 is moved between the upper and lower positions, the slide is also moved within the housing 10 the same distance that the screw is moved. The results in movement of the solenoid 40 and its blocking element 60 (shown in FIGS. 4-6) between two positions. In the embodiment of the electric strike 10 according to the present invention, the fail-safe mode is provided with the screw 84 at the upper position as shown in FIG. 8, and the fail-secure mode is provided with the screw 84 at its lower position as shown in FIG. 9.

FIG. 10 shows the electric strike 10 with the mode control screw 84 removed from the mode control slot 86. The slot 86 is shown as having a generally hour-glass shape that allows for the mode control screw to be fully turned in and secured in place in either the upper position (hole) 86*a* or in the lower position 86*b*. To change positions the screw is loosened such that the head of the screw is outside of its one of the upper and lower positions 86*a*, 86*b*. The shaft of the screw can then slide between the positions through the narrow portion 86*c* of the slot 86. This allows for the screw 84 to be changed between its upper and lower positions without removing the screw 84 from the slide 56. The slide 56 and solenoid 40 (shown in FIGS. 4-6) are held firmly in place within the housing by the mode control screw 84 and the surrounding surfaces of the housing 12. That, the surrounding housing surfaces and mode control screw 84 hold the slide 56 and solenoid 40 in place against the force of the keeper in the locked of fail-safe mode.

FIGS. 11 and 12 show the electric strike 10 with the back plate removed to reveal the strike's internal components. The electric strike 10 in FIG. 11 shows the internal components when the mode control screw is at the upper or fail-safe mode position. The electric strike 10 in FIG. 12 shows the internal components when the mode control screw is at the lower or fail-secure mode position.

Referring to FIG. 11, the solenoid 40 is arranged so that the plunger extends from the solenoid body 42 when electrical power is removed or lost. The blocking element 60 is shown in a position whereby is it abutting one of the keeper's abutting surfaces 38, thereby blocking pivot of the keeper 14. This results in the latch bolt being held in the electric strike 10 by the keeper in the locked condition. When power is lost or removed, the plunger extends from the solenoid body such that the blocking element 60 is between the abutting surfaces 38. The keeper is allowed to pivot so that the door's latch bolt can be removed from the electric strike 10.

Referring now to FIG. 12, the blocking element 60 is shown in a position below the abutting surfaces 38, which allows for the keeper to pivot so that latch can be removed. When power is lost or removed, the plunger extends from the solenoid 40 and the blocking element 60 abuts one of the keepers abutting surfaces 38 thereby blocking pivot of the keeper 14.

Although the present invention has been described in detail with reference to certain preferred configurations thereof, other versions are possible. Therefore, the spirit and scope of the invention should not be limited to the versions described above.

We claim:

1. An electric strike, comprising:

a housing;

a keeper pivotally mounted to said housing;

an actuating device controlled by an electrical signal, arranged internal to said housing and moveable between two positions;

a single mode control screw mounted to said electrical strike and positioned to hold said actuating device in one of at least two device positions when said screw is tightened, said screw also capable of moving between two screw positions by loosening said screw, the movement of said screw causing movement of said actuating device between said device positions, wherein said screw does not have to be completely removed to allow movement of said actuating device between said device positions; and a blocking element connected to said actuating device, in one of said two mode control screw positions said blocking element blocking pivot of said keeper when said electrical signal is lost, and in the other of said mode control screw positions allowing pivot of said keeper when said electrical signal is lost.

2. The electric strike of claim 1, wherein said actuating device comprises a solenoid.

3. The electric strike of claim 2, wherein said solenoid comprises a plunger, said blocking elements mounted to said plunger.

4. The electric strike of claim 1, wherein said keeper has an abutting surface, said blocking element abutting said abutting surface when blocking pivot of said keeper.

5. The electric strike of claim 1, further comprising a slide, said actuating element mounted to said slide and said mode control screw mounted to said slide, said slide moving when said screw is moved.

6. The electric strike of claim 1, comprising a plurality of switches, each of which monitors the position of a moving element within said electric strike.

7. The electric strike of claim 1, operating in fail-safe mode when said screw is in one of said two positions and fail-secure mode when said screw is in the other of said two positions.

8. An electric strike, comprising:

a housing;

a keeper pivotally mounted to said housing;

a two position mode control slot in said housing, said slot having a generally hour-glass shape;

a mode control screw in said mode control slot capable of being moved between said two position and said generally hour-glass shape allowing said mode control screw to be tightened in each of said two positions in said slot without removal of said screw, said screw being changeable between the two of said positions by loosening but not having to completely remove said screw, said electric strike operating in fail-safe mode when said screw is in one of said two positions and fail-secure mode when said screw is in the other of said two positions.

9. The electric strike of claim 8, further comprising an actuating device controlled by an electrical signal, arranged internal to said housing and moveable between two positions, the movement of said mode control screw causing movement of said actuating device.

10. The electric strike of claim 8, further comprising a solenoid controlled by an electrical signal, arranged internal to said housing and moveable between two positions, the movement of said mode control screw causing movement of said solenoid.

11. The electric strike of claim 10, wherein said solenoid further comprises a plunger and a blocking element connected to said plunger.

12. The electric strike of claim 11, wherein said blocking element blocks pivot of said keeper in said fail-secure mode when said electrical signal is lost, and allowing pivot of said keeper in said fail-safe mode when said electrical signal is lost.

13. The electric strike of claim 12, wherein said keeper has an abutting surface, said blocking element abutting said abutting surface when blocking pivot of said keeper.

14. The electric strike of claim 8, comprising a plurality of switches, each of which monitors the position of a moving element within said electric strike.

15. The electric of claim 8, wherein said generally hour-glass shape comprises two counterbores in said housing connected by said slot.

16. An electric strike, comprising:

a housing;

a keeper pivotally mounted to said housing;

a solenoid arranged internal to said housing and moveable between fail-safe and fail-secure positions;

a two position mode control slot in said housing, wherein each of said two positions comprises a tapered counterbore in said housing;

a single mode control screw in said mode control slot capable of being tightened in each of said two positions in said slot, said screw being changeable between the two of said positions along said slot without removal of said screw, said solenoid being in said fail-safe position when said screw is in one of said two positions and in said fail-secure position when said screw is in the other of said two positions.

17. The electric strike of claim 16, wherein said solenoid further comprises a plunger and a blocking element connected to said plunger.

18. The electric strike of claim 17, wherein said blocking element blocks pivot of said keeper in said fail-secure mode when said electrical signal is lost, and allowing pivot of said keeper in said tail-safe mode when said electrical signal is lost.

19. The electric strike of claim 18, wherein said keeper has an abutting surface, said blocking element abutting said abutting surface when blocking pivot of said keeper.

20. The electric strike of claim 16, comprising a plurality of switches, each of which monitors the position of a moving element within said electric strike.

21. The electric strike of claim 16, further comprising a slide, said solenoid mounted to said slide and said mode control screw mounted to said slide, said slide moving when said screw is moved between said two positions.

* * * * *

UNITED STATES PATENT AND TRADEMARK OFFICE

CERTIFICATE OF CORRECTION

PATENT NO. : 7,540,542 B2
APPLICATION NO. : 11/725110
DATED : June 2, 2009
INVENTOR(S) : Arthur V. Geringer It is certified that error appears in the above-identified patent and that said Letters Patent is hereby corrected as shown below:

- Column 8, Claim 18, Line 51 reads as: "keeper in said tail-safe mode when said electrical signal is". It should read as: "keeper in said fail-safe mode when said electrical signal is"

Signed and Sealed this

Third Day of November, 2009

David J. Kappos

David J. Kappos
*Director of the United States Patent and Trademark Office*

US007540542C1

(12) EX PARTE REEXAMINATION CERTIFICATE (8077th)

United States Patent
Geringer et al.

(10) Number: US 7,540,542 C1
(45) Certificate Issued: Mar. 8, 2011

(54) ELECTRIC STRIKE

(75) Inventors: Arthur V. Geringer, Oak Park, CA (US); David A. Geringer, Camarillo, CA (US); Richard Geringer, Moorpark, CA (US)

(73) Assignee: Security Door Controls, Westlake Village, CA (US)

Reexamination Request:
No. 90/010,613, Sep. 14, 2009

Reexamination Certificate for:

| | |
|---|---|
| Patent No.: | **7,540,542** |
| Issued: | **Jun. 2, 2009** |
| Appl. No.: | **11/725,110** |
| Filed: | **Mar. 14, 2007** |

Certificate of Correction issued Nov. 3, 2009.

(51) Int. Cl.
*E05B 15/02* (2006.01)

(52) U.S. Cl. ..... 292/341.16; 292/341.17

(58) Field of Classification Search ..... 292/144, 292/341.16, 341.17
See application file for complete search history.

(56) References Cited

U.S. PATENT DOCUMENTS 6,874,830 B2 4/2005 Bashford

*Primary Examiner*—Sara Clarke

(57) ABSTRACT

An electric strike comprising a housing and a keeper pivotally mounted to said housing. A solenoid is arranged internal to the housing and movable between fail-safe and fail-secure positions. A two position mode control slot is included in the housing and a mode control screw is included in the mode control slot. The screw is capable of being tightened in each of the two positions in the control slot. The screw is changeable between the two of the positions without removal of the screw. The solenoid is in the fail-safe position when the screw is in one of the two positions and in the fail-secure position when the screw is in the other of the two positions.

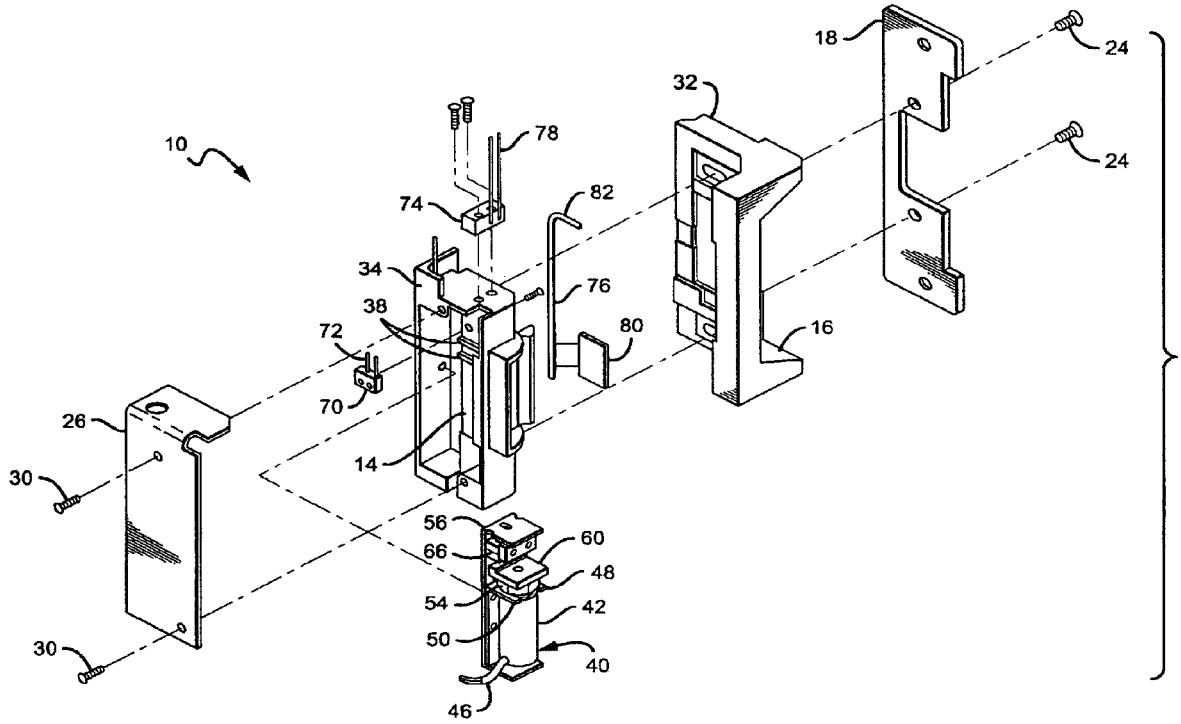

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 16, 17, 20 and 21 is confirmed.

Claims 1 and 18 are determined to be patentable as amended.

Claims 2-7 and 19, dependent on an amended claim, are determined to be patentable.

Claims 8-15 were not reexamined.

1. An electric strike, comprising:

a housing;

a keeper pivotally mounted to said housing;

an actuating device controlled by an electrical signal, arranged internal to said housing and movable between two positions;

a single mode control screw mounted to said electrical strike and positioned to hold said actuating device in one of at least two device positions when said screw is tightened, *wherein each of said at least two device positions comprises a tapered hole in said housing*, said screw also capable of moving between two screw positions by loosening said screw, the movement of said screw causing movement of said actuating device between said device positions, wherein said screw does not have to be completely removed to allow movement of said actuating device between said device positions; and a blocking element connected to said actuating device, in one of said two mode control screw positions said blocking element blocking pivot of said keeper when said electrical signal is lost, and in the other of said mode control screw positions allowing pivot of said keeper when said electrical signal is lost.

18. The electric strike of claim 17, wherein said blocking element blocks pivot of said keeper in said fail-secure mode when said electrical signal is lost, and allowing pivot of said keeper in said [tail-safe] *fail-safe* mode when said electrical signal is lost.

* * * * *